US008888414B2

(12) United States Patent
Hall

(10) Patent No.: US 8,888,414 B2
(45) Date of Patent: Nov. 18, 2014

(54) GROUTED CYLINDRICAL CONNECTION UTILIZING BEARING SURFACES FOR OFFSHORE MONOPILE FOUNDATIONS

(71) Applicant: Keystone Engineering, Inc., Mandeville, LA (US)

(72) Inventor: Rudolph A. Hall, Mandeville, LA (US)

(73) Assignee: Keystone Engineering, Inc., Mandeville, LA (US)

( * ) Notice: Subject to any disclaimer, the term of this patent is extended or adjusted under 35 U.S.C. 154(b) by 0 days.

(21) Appl. No.: 13/686,453

(22) Filed: Nov. 27, 2012

(65) Prior Publication Data

US 2013/0156509 A1 Jun. 20, 2013

Related U.S. Application Data

(60) Provisional application No. 61/564,109, filed on Nov. 28, 2011, provisional application No. 61/567,490, filed on Dec. 6, 2011.

(51) Int. Cl.
*E02D 5/48* (2006.01)

(52) U.S. Cl.
CPC ..... *E02D 5/48* (2013.01)
USPC ..... 405/252; 405/251; 405/216

(58) Field of Classification Search
CPC ..... E02D 5/48; E02D 5/50; E02D 5/52; E02D 5/526
USPC ..... 405/216, 250, 251, 252, 256, 257
See application file for complete search history.

(56) References Cited

U.S. PATENT DOCUMENTS

| | | | | | |
|---|---|---|---|---|---|
| 1,834,752 | A | * | 12/1931 | Upson | 405/257 |
| 3,125,858 | A | * | 3/1964 | Baittinger | 405/251 |
| 3,793,794 | A | * | 2/1974 | Archer et al. | 52/632 |
| 3,851,483 | A | * | 12/1974 | Holley, Jr. | 405/232 |
| 4,585,681 | A | * | 4/1986 | Kidera et al. | 405/231 |
| 4,770,585 | A | * | 9/1988 | Astl | 411/446 |

(Continued)

FOREIGN PATENT DOCUMENTS

| | | | |
|---|---|---|---|
| JP | H08-284159 | A | 10/1996 |
| JP | 2003-193486 | A | 7/2003 |
| JP | 2004-211479 | A | 7/2004 |
| WO | 95/29780 | A2 | 11/1995 |

OTHER PUBLICATIONS

The International Search Report and the Written Opinion of the International Searching Authority dated Feb. 28, 2013, which corresponds to International Application No. PCT/US2012/066657 and is related to U.S. Appl. No. 13/686,453.

(Continued)

*Primary Examiner* — Benjamin Fiorello
(74) *Attorney, Agent, or Firm* — Studebaker & Brackett PC

(57) ABSTRACT

A grouted cylindrical connection utilizing bearing surfaces can be used with conventional transition-monopile foundations to connect the large diameter cylindrical shaped monopile to the larger diameter cylindrical shaped transition section which includes appurtances. The grouted cylindrical connection includes a cylindrical shaped monopile, a cylindrical shaped transition section receiving the monopile, an annulus being formed between the monopile and the transition section, and first and second bearing elements disposed in the annulus. The first bearing element is attached to the transition section and the second bearing element is attached to the monopile. The annulus is filled with grout to transmit force and moment between the transition section and the monopile through grout between the first and second bearing elements.

16 Claims, 6 Drawing Sheets

(56) References Cited

U.S. PATENT DOCUMENTS

| | | | | |
|---|---|---|---|---|
| 4,983,072 | A * | 1/1991 | Bell, Jr. | 405/216 |
| 5,228,806 | A * | 7/1993 | De Medieros et al. | 405/231 |
| 5,591,265 | A * | 1/1997 | Tusch | 118/404 |
| 6,123,485 | A * | 9/2000 | Mirmiran et al. | 405/252 |
| 6,536,991 | B1 * | 3/2003 | Trader et al. | 405/216 |
| 7,300,229 | B1 * | 11/2007 | Fyfe et al. | 405/216 |
| 2002/0094239 | A1 * | 7/2002 | Bradley et al. | 405/216 |
| 2004/0211479 | A1 | 10/2004 | Ryu et al. | |
| 2006/0185279 | A1 | 8/2006 | Eusterbarkey | |
| 2013/0156509 | A1 * | 6/2013 | Hall | 405/252 |

OTHER PUBLICATIONS

Notification Concerning Transmittal of International Preliminary Report on Patentability and the Written Opinion of the International Searching Authority dated Jun. 12, 2014, which corresponds to International Application No. PCT/US2012/066657 and is related to U.S. Appl. No. 13/686,453.

* cited by examiner

GROUTED CYLINDRICAL CONNECTION UTILIZING BEARING SURFACES FOR OFFSHORE MONOPILE FOUNDATIONS

CROSS-REFERENCE TO RELATED APPLICATIONS

This application claims the benefits of U.S. Provisional Applications No. 61/564,109, filed Nov. 28, 2011 and No. 61/567,490, filed Dec. 6, 2011, the entire contents of which are hereby incorporated by reference.

BACKGROUND

1. Technical Field

This disclosure generally relates to monopile foundations commonly employed to support offshore structures and particularly wind turbine generators positioned offshore. In particular, the disclosed embodiment relates to the grouted cylindrical connection between the transition section supporting the wind turbine tower and the single foundation element, or monopile, which transmits the forces and moments from the transition section into the soil strata below the seafloor.

2. Description of the Related Art

Conventional transition—monopile foundations employ a large diameter cylindrical shaped monopile typically driven into the seafloor having adequate length to extend above the sea surface. The larger diameter transition section, including appurtenances for access, egress, maintenance, cable support and equipment support along with a mating flange for connection to the wind turbine tower flange, is lifted and lowered over the monopile until temporarily supported on landing points inside the transition. The landing points are equipped with a hydraulic leveling system or other means to adjust the transition to achieve vertical tolerance when the driven monopile is out of vertical tolerance. After correcting vertically to within acceptable tolerance, the transition section is connected to the monopole by filling the annulus space between the transition and monopile with grout. The forces and moments acting on the transition are transmitted through the grout primarily by shear into the monopile. In order to increase the adhesion between the inner wall of the transition section and the outer wall of the monopiles, shear keys (typically concentric rows of weld beads or rolled flat bars) are applied to both surfaces of the annulus. However, recent long term experience has identified a failure mechanism that requires a departure from the conventional grouted cylindrical connection. The common solution to mitigate grout failure is to add conical sections to the transition section and monopile. However, this solution adds significant cost and the supply of large diameter conical sections has limitations. Further, the mounting of offshore wind turbine towers to transition sections with a cylindrical section require a grouted connection with adequate strength to transmit the forces and moments to the monopile and having excellent fatigue resistance characteristics due to the extensive cyclic loading induced by the wind and waves.

SUMMARY

A grouted cylindrical connection utilizing bearing surfaces to transmit the forces and moments applied by the wind turbine tower offers an alternative method of connecting a transition section to a monopile that can significantly reduce cost and improve supply compared to using the aforementioned conical section grouted connection method.

A grouted cylindrical connection according to an embodiment of the present invention includes a cylindrical shaped monopile, a cylindrical shaped transition section receiving the monopile, an annulus being formed between the monopile and the transition section, and first and second bearing elements disposed in the annulus. The first bearing element is attached to the transition section and the second bearing element is attached to the monopile. The annulus is filled with grout to transmit force and moment between the transition section and the monopile through grout between the first and second bearing elements.

BRIEF DESCRIPTION OF THE DRAWINGS

The apparatus, system and method will now be described in detail with reference to the following figures wherein:

FIG. 6(*b*) is a cut away view in plan showing the transition section grouted to the monopile according to the disclosed embodiment utilizing equally spaced circumferential segmented bearing elements.

DETAILED DESCRIPTION

An exemplary embodiment of grouted cylindrical connection utilizing bearing surfaces for offshore monopile foundations according to the disclosed embodiment will be described in relation to an offshore wind turbine nacelle, rotor, blades and support tower mounted to a cylindrical transition section grouted to a cylindrical monopile. However, to avoid unnecessarily obscuring the disclosed embodiment, the following description omits well known structures and devices that may be shown in block diagram or otherwise summarized. For the purpose of explanation, numerous specified details arose forth in order to provide a thorough understanding of the disclosed embodiment. It should be appreciated that the disclosed embodiment may be practiced in a variety of ways beyond the specified details. For example, the disclosed systems and methods can be generally expanded and applied to grouted cylindrical connections between larger or smaller diameter transition sections and monopiles, with larger or smaller annuli, and with continuous or segmented bearing elements constructed of half pipes grout filled or void, or other constructions of bearing elements. Furthermore, while exemplary distances and scales are shown in the figures, it is to be appreciated the system and methods can be varied to fit any particular implementation.

Figure 1:
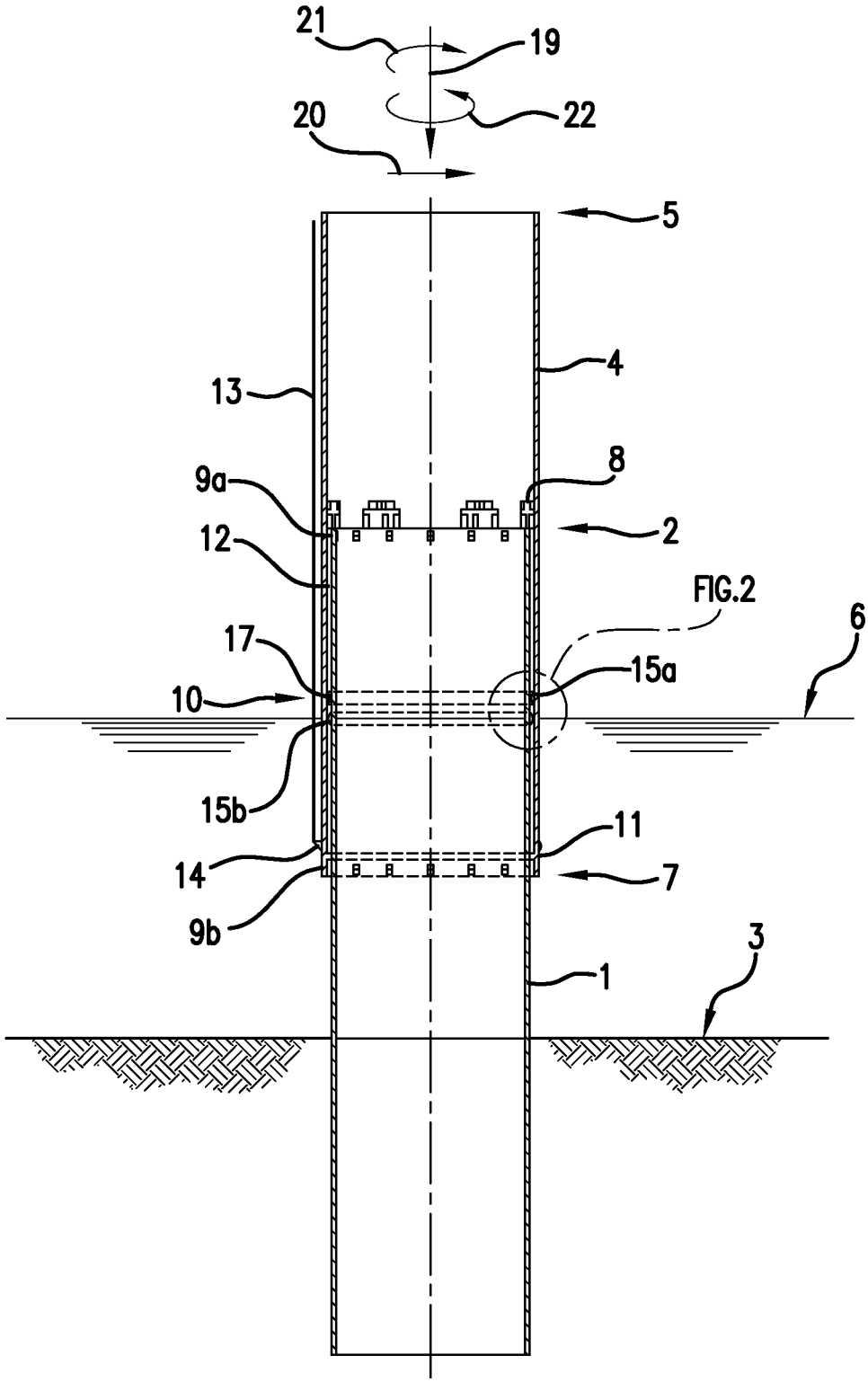
FIG. 1 is a cut away view in elevation of the transition section and monopile assembles according to the disclosed embodiment utilizing continuous circumferential bearing elements.

A grouted cylindrical connection according to an embodiment of the present invention includes, as shown in FIG. 1, a cylindrical shaped monopile 1, a cylindrical shaped transition section 4 receiving the monopile 1, an annulus formed between the monopile 1 and the transition section 4, and first and second bearing elements 15*a*, 15*b* disposed in the annulus. The first bearing element 15*a* is attached to the transition section 4 and the second bearing element 15*b* is attached to the monopile 1. The annulus is filled with grout to transmit force and moment between the transition section 4 and the monopile 1 through grout between the first and second bearing elements 15*a*, 15*b*. A diameter of the transition section 4 is larger than a diameter of the monopile 1. The first bearing element 15*a* is attached to an outer wall of the monopile 1 and the second bearing element 15*b* is attached to an inner wall of the transition section 4. The first bearing element 15*a* may be continuously formed on a circumference of the inner wall of the transition section 4. The second bearing element 15*b* may be continuously formed on a circumference of the outer wall of the monopile 1. The first bearing element 15*a* may be a half pipe filled with grout rolled to a radius of the inner wall of the transition section 4 and welded to the inner wall of the transition section 4 and the second bearing element may be a half pipe filled with grout rolled to a radius of the outer wall of the monopile 1 and welded to the outer wall of the monopile 1. The grouted cylindrical connection includes a flexible seal 11 positioned between the outer wall of the monopile 1 and the inner wall of the transition section 4 to close the annulus. The grouted cylindrical connection includes a centralizer 17 mounted on at least one of the first and second bearing elements 15*a*, 15*b*. A method for forming grouted cylindrical connection according to an embodiment of the present invention, includes the steps of: providing a cylindrical shaped transition section 4 to which at least one first bearing element 15*a* is attached, providing a cylindrical shaped monopile 1 to which at least one second bearing element 15*b* is attached, lowering the transition section 4 over the monopile 1 along an axial direction of the monopile 1 to form an annulus between the monopile 1 and the transition section 4, and filling the annulus with grout to transmit force and moment between the transition section 4 and the monopile 1 through grout between the first and second bearing elements 15*a*, 15*b*. The first and second bearing elements 15*a*, 15*b* are positioned in the annulus.

FIG. 1 shows in a cut away view in elevation of the monopile 1 and the transition section 4 and assembles utilizing continuous circumferential bearing elements 15*a* and 15*b*. The monopile 1 is driven or otherwise penetrates the sea floor 3 and extends above the sea surface 6. The transition section 4 is lowered over the monopile 1 until the transition section 4 landing points 8 rests on the top of the monopile 2 and the bottom of the transition section 7 extends below the sea surface 6. The top of the transition section 5 is leveled utilizing hydraulic system or other means incorporated with the landing points 8. The upper continuous circumferential bearing element 15*a* is located at a pivot elevation 10 on the inner wall of the transition section 4 half way between centralizers 9*a* and 9*b* on the inner wall of the transition section 4. Centralizers 17 are mounted on the upper continuous bearing element 15*a* to maintain adequate annular clearances for grout flow. The lower continuous bearing element 15*b* is attached to the outer wall of the monopile 1 below the upper continuous bearing element 15*a*. The annulus formed between the monopile 1 and the transition section 4 is filled with grout 12. The annulus space is closed at the bottom with the flexible seal 11. Grout is pumped thru a grout piping 13 into a grout distributor 14. The grouted cylindrical connection transmits vertical force 19, horizontal force 20, overturning moment 21 and torsional moment 22 acting on the transition section 4, thru the grout between the bearing elements 15*a* and 15*b*, to the monopile 1 and into soil strata.

Figure 2:
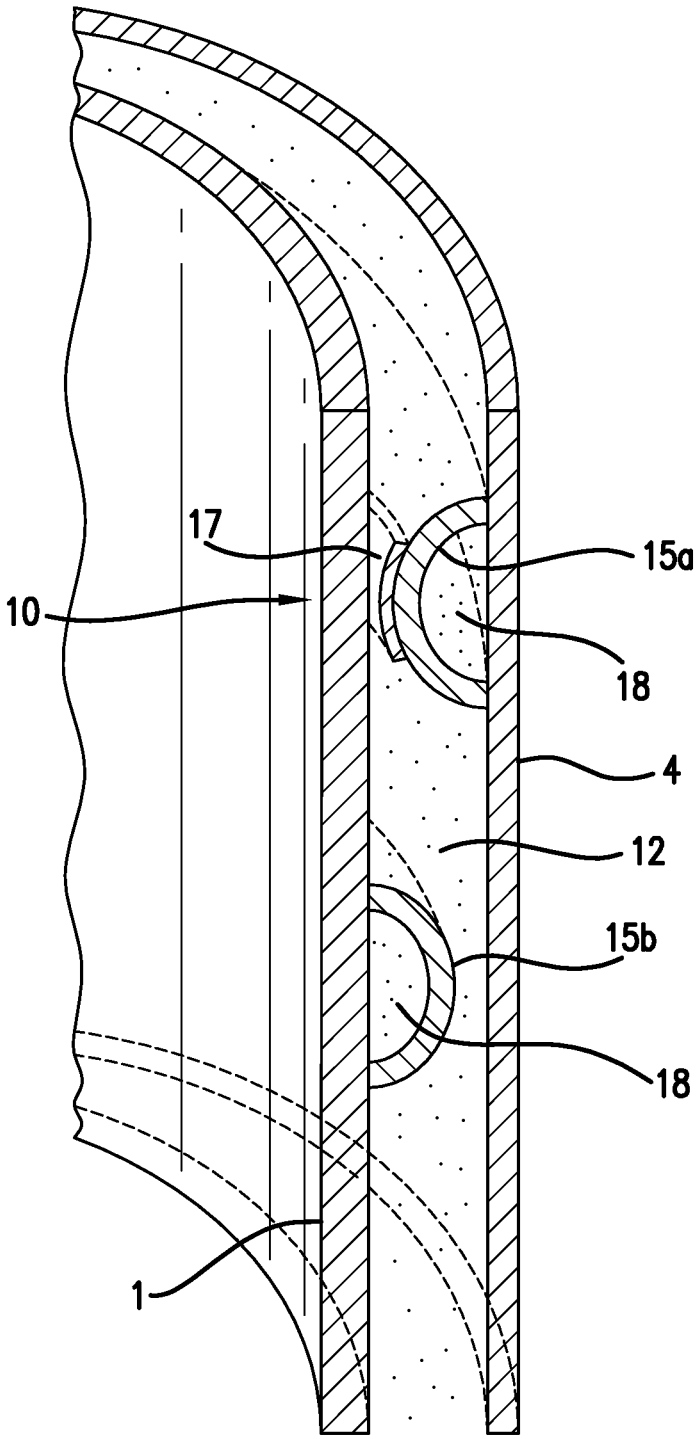
FIG. 2 is a cut away view in elevation showing the continuous circumferential grout-filled half pipe bearing elements.

FIG. 2 is a cut away view in elevation showing the upper continuous half pipe bearing element 15*a* filled with grout 18 and attached to the inner wall of the transition section 4 with the centralizer 17 at the pivot elevation 10, the lower continuous half pipe bearing element 15*b* filled with grout 18 and attached to the outer wall of the monopile 1, and the annulus space formed between the inner wall of the transition section 4 and the outer wall of the monopile 1 and filled with grout 12.

Figure 3:
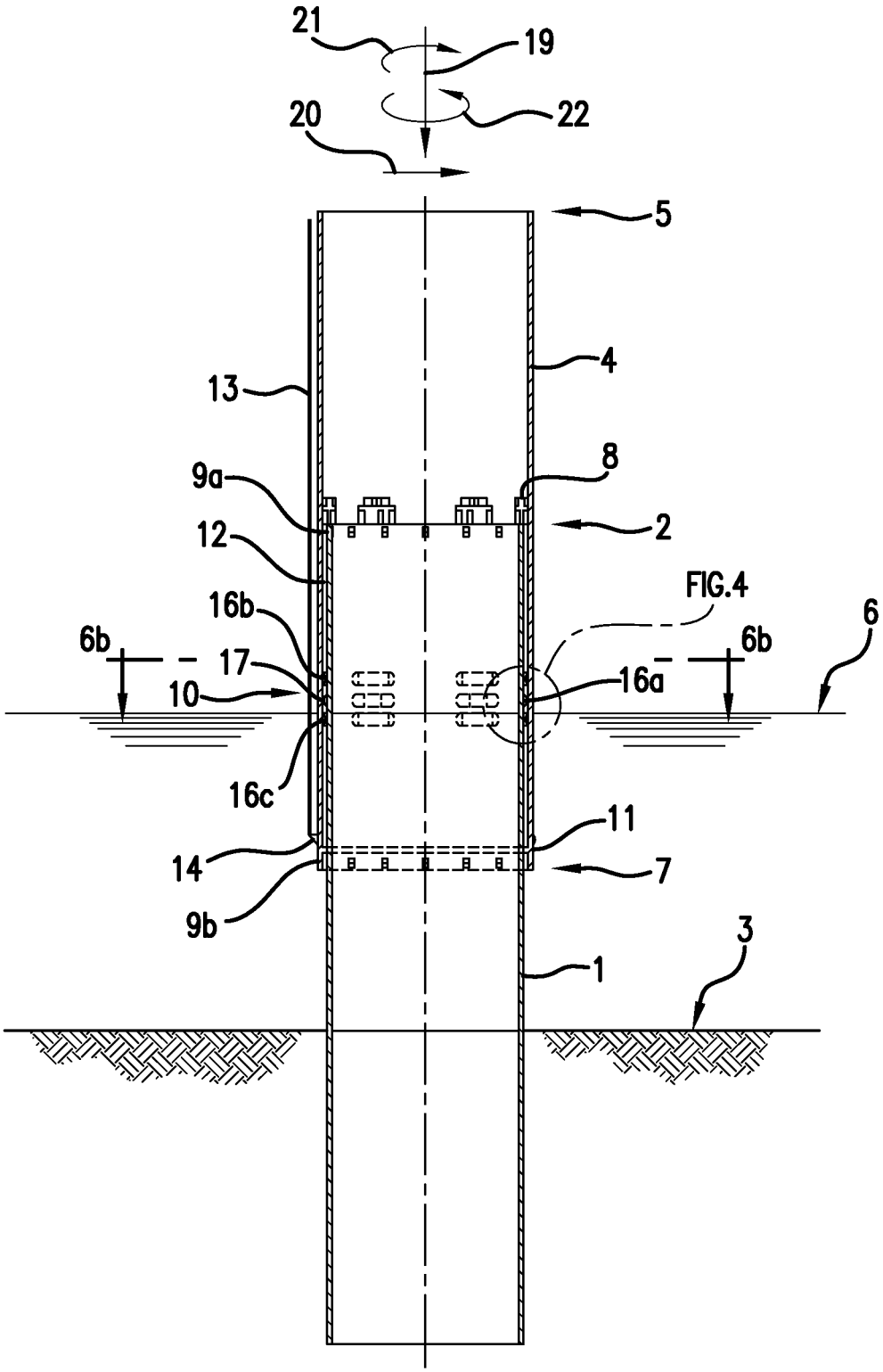
FIG. 3 is a cut away view in elevation of the transition section and monopile assemblies according to the disclosed embodiment utilizing equally spaced circumferential segmented bearing elements.

In the grouted cylindrical connection according to an embodiment of the present invention, as shown in FIG. 3, the first bearing element may include at least one first segmented bearing element 16*b* partially formed on a circumference of an inner wall of the transition section 4; and the second bearing element may include at least one second segmented bearing element 16*a* partially formed on a circumference of an outer wall of the monopile 1. The first segmented bearing element and the second segmented bearing element may be longitudinally aligned in an axial direction of the monopile. The grouted cylindrical connection may include at least one third segmented bearing element 16*c* attached to at least one of the transition section and the monopile in the annulus and aligned with the first and second segmented bearing elements 16*b*, 16*b* in an axial direction of the monopile 1. The first bearing element may include a plurality of first segmented bearing elements formed on a circumference of an inner wall of the transition section 4, and the second bearing element may include a plurality of second segmented bearing elements formed on a circumference of an outer wall of the monopile 1. The plurality of first segmented bearing elements may be equally spaced from adjacent first segmented bearing element, and the plurality of second segmented bearing elements may be equally spaced from adjacent second segmented bearing element. A distance between adjacent second segmented bearing elements may be larger than a length of the first segmented bearing elements. The grouted cylindrical connection may include caps 23 disposed on and welded to each end of the first and second segmented bearing elements.

FIG. 3 shows in a cut away view in elevation the monopile 1 and the transition section 4 assembles utilizing equally spaced circumferential segmented bearing elements 16*a*, 16*b*, and 16*c*. The monopile 1 is driven or otherwise penetrates the sea floor 3 and extends above the sea surface 6. The transition section 4 is lowered over monopile 1 until landing points 8 of the transition section 4 rests on the top of the monopile 2 and the bottom of the transition section 7 extends below the sea surface 6. The top of the transition section 5 is leveled utilizing a hydraulic system or other means incorporated with the landing points 8. The middle circumferential segmented bearing element 16*a* is located at the pivot elevation 10 on the outer wall of the monopile 1 halfway between the centralizers 9*a* and 9*b* on the inner wall of the transition section 4. Centralizer 17 is mounted on the middle segmented bearing element 16*a* to maintain adequate annular clearances for grout flow. The upper segmented bearing element 16*b* is attached to the inner wall of the transition section 4 above the pivot elevation 10 and the lower segmented bearing element 16*c* is attached to the inner wall of the transition section 4 below the pivot elevation 10. The annulus formed between the monopile 1 and the transition section 4 is filled with grout 12. The annulus space is closed at the bottom with a flexible seal 11. Grout is pumped thru grout piping 13 into the grout distributor 14. The grouted cylindrical connection transmits vertical force 19, horizontal force 20, overturning moment 21 and torsional moment 22 acting on the transition section 4, thru the grout between bearing elements 16*a* and 16*b* and 16*c*, to the monopile 1 and into the soil strata.

Figure 4:
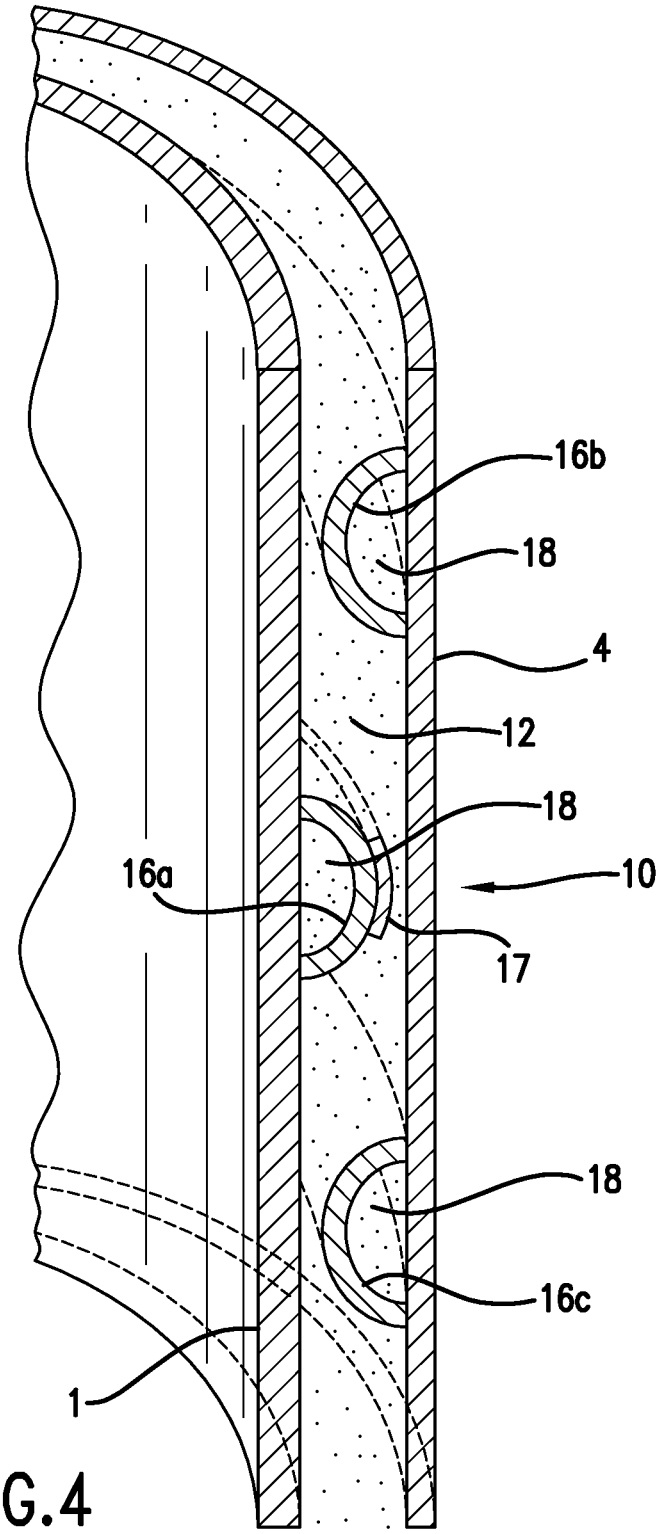
FIG. 4 is a cut away view in elevation showing the equally spaced circumferential segmented grout-filled half pipe with the half pipe cap ends of equal length bearing elements.

FIG. 4 is a cut away view in elevation showing the middle segmented half pipe 16*a* bearing element filled with grout 18 attached to the outer wall of the monopile 1 with centralizer 17 at the pivot elevation 10, the upper and lower segmented half pipes bearing elements 16*a* and 16*b* filled with grout 18 located above and below the pivot elevation 10 attached to the inner wall of the transition section 4, and the annulus space formed between the inner wall of the transition section 4 and the outer wall of the monopile 1 and filled with grout 12.

A method for forming grouted cylindrical connection according to an embodiment of the present invention includes the steps of providing a cylindrical shaped transition section 4 to which first segmented bearing elements are attached, providing a cylindrical shaped monopile 1 to which second segmented bearing elements are attached, lowering the transition section over the monopile 1 such that the first bearing segmented elements passes through a gap between the second segmented bearing elements, rotating the transition section 4 to align the first segmented bearing elements with the second segmented bearing elements in a state where the first and second segmented bearing elements are longitudinally aligned in an axial direction of the monopile 1, and filling an annulus between the cylindrical shaped monopile 1 and the cylindrical shaped transition section 4 with grout to transmit force and moment between the transition section 4 and the monopile 1 through grout between the first and second bearing elements.

Figure 5:
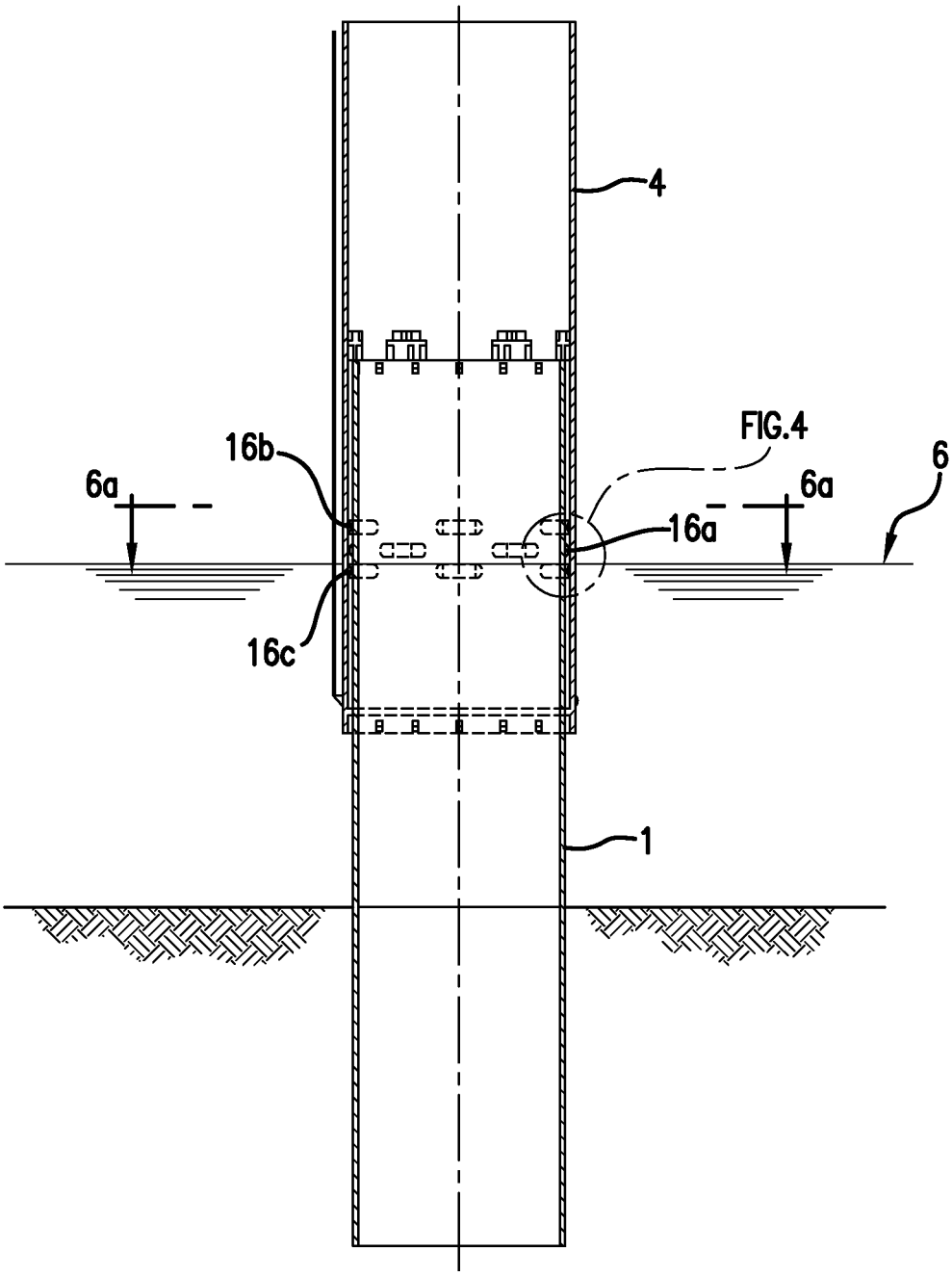
FIG. 5 is a cut away view in elevation of the transition section and monopile during lowering of the transition section over the monopile according to the disclosed embodiment utilizing equally spaced circumferential segmented bearing elements.

FIG. 5 is a cut away view in elevation of the monopile 1 and the transition section 4 during lowering of the transition section 4 over the monopile 1 showing the lower segmented half pipe 16*c* attached to the inner wall of the transition section 4 passing through the gap between the middle segmented half pipe bearing elements 16*a* attached to the outer wall of the monopile 1.

Figure 6A:
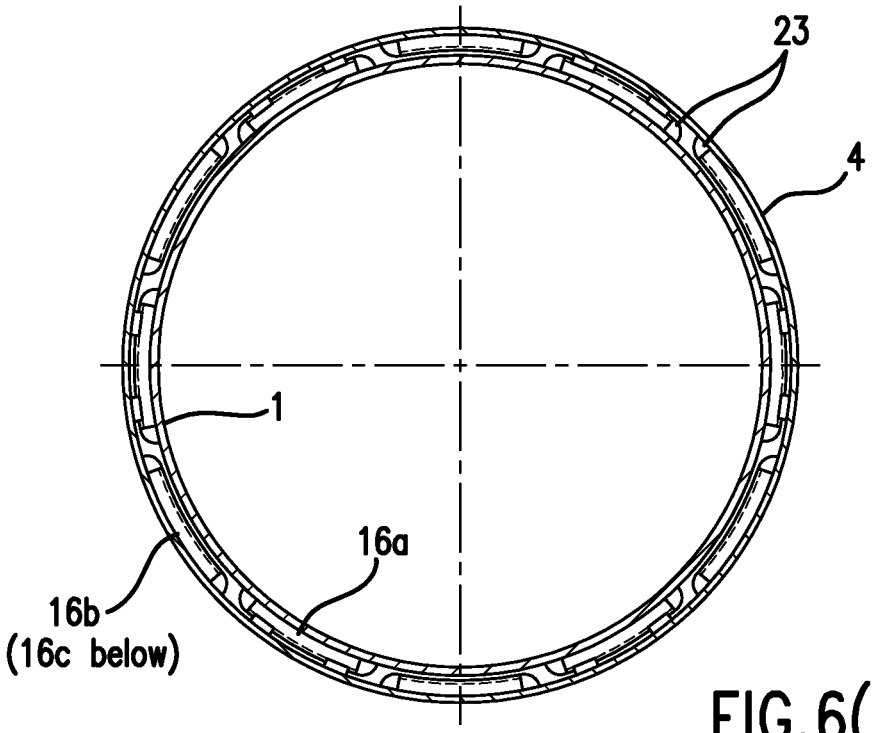
FIG. 6(*a*) is a cut away view in plan showing the transition section and monopole during lowering of the transition section over the monopile according to the disclosed embodiment utilizing equally spaced circumferential segmented bearing elements.
Figure 6B:
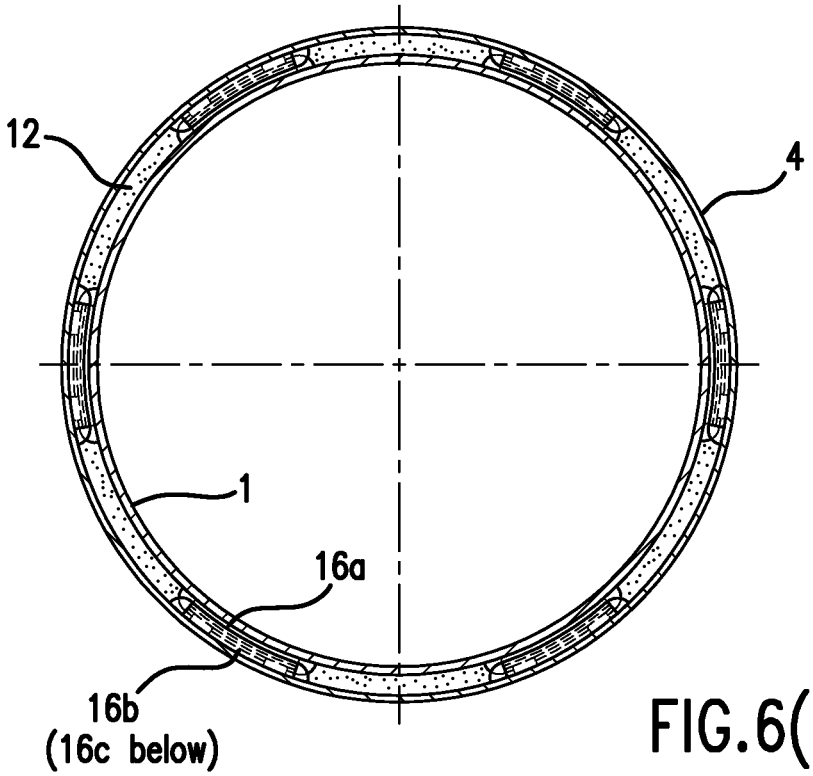

FIG. 6(*a*) is a cut away view in plan showing the monopile 1 and the transition section 4 during lowering of the transition section 4 and the monopile 1 during lowering of the transition section 4 over the monopile 1 with the lower segmented half pipe bearing element 16*c* below the upper segmented half pipe bearing elements 16*b* attached to the inner wall of the transition 4 passing between the middle segmented half pipe bearing elements 16*a* attached to the outer wall of the monopile 1. Half pipe caps 23 are attached to the ends of the segment half pipe bearing elements 16*a*, 16*b* and 16*c*.

FIG. 6(*b*) is a cut away view in plan showing the monopile 1 and the transition section 4 connected by grout 12 in the annulus with the upper, middle and lower segmented half pipe bearing elements 16*a*, 16*b* and 16*c* aligned (or vertically stacked).

As can be appreciated from the foregoing discussion, the apparatus, system and method set forth provides a grouted cylindrical connection utilizing bearing surfaces to transmit the forces and moments applied by the wind turbine tower, and offers an alternative method of connecting a transition section to a monopile that can significantly reduce cost and improve supply compared to using the aforementioned conical section grouted connection method. The method permits members to be joined in such a matter to allow the full forces and moments developed in the wind turbine tower assemblies during operating and extreme loading events to be transmitted to the substructure. In accordance with the disclosed embodiment the design of the grouted connection maximizes fatigue performance, stiffness and load transfer while minimizing cost and maximizing supply options. Further, in doing so, the bearing elements are attached to the inner wall of the transition section and the outer wall of the monopile in a manner which allows the transfer axial forces and the overturning moments as vertical couples through the grout between bearing elements in vertical compression from the transition section to the monopile. Still further, horizontal shear forces and the overturning moments as horizontal couples are transferred through the grout between the inner wall of the monopile in horizontal compression from the transition section to the monopole.

With the structure described in detail hereinabove, continuous circumferential bearing elements and equally spaced circumferential segmented bearing elements of equal length are realized. In the case of continuous circumferential bearing elements the upward couple of the overturning moment is resisted by grout between the inner wall of the transition section and outer wall of the monopile in vertical shear. Conversely, the case of segmented bearing elements resists both upward and downward couple of the overturning moment in bearing on the grout between the bearing elements. Also, with the disclosed embodiment, the segmented bearing elements transfer torsional moments in horizontal shear through the grout between the adjacent inner wall of the transition section to the outer wall of the monopile.

As can be appreciated from the foregoing detailed description, the described apparatus, system and method allows for half pipes filled with grout rolled to the radius of the inner wall of the transition section and welded to the inner wall of the transition section, and half pipes filled with grout rolled to the radius of the outer wall of the monopile and welded to the outer wall of the monopile to function as the bearing elements. In the ease of segmented bearing elements, half pipe caps can be welded to the ends of the half pipe segments. Further, with the described apparatus, system and method, the case of the segmented bearing elements requires the transition section to be aligned with the monopile such that the transition section can be lowered over the monopile during installation and the segmented bearing elements on the inner wall of the transition section will pass through the gap between the segmented bearing elements on the outer wall of the monopile. The transition section is rotated to align the segmented bearing elements on the inner wall of the transition section directly above and below the segmented bearing elements of the wall of the monopile.

In Accordance with the described apparatus, system and method, the grouted cylindrical connections utilizing bearing surfaces can develop the full strength required for service and the grouted cylindrical connection utilizing bearing surface eliminates the requirement for conical transition sections and monopiles, thereby reducing cost an improving supply. Further, the vertical force due to the weight of the wind turbine tower can be transferred between the transition section and monopile by compression in the grout between the bearing elements attached to the inner wall of the transition section and outer wall of the monopile.

Additionally, the overturning moment vertical couple can be transferred between the transition section and the monopile by compression in the grout between the bearing elements attached to the inner wall of the transition section and the outer wall of the monopole. Further, the horizontal forces and overturning moment horizontal couple can be transferred between the transition section and the monopile by compression in the grout between the inner wall of the transition and the outer wall of the monopile. Still further, the torsional moment can be transferred between the transition section and the monopile by shear between the bearing elements attached to the inner wall of the transition section and the outer wall of the monopile. In doing so, the bearing elements allow the transfer of vertical forces, horizontal forces, vertical overturning moment couples and horizontal overturning moment couples through the grout between the bearing surfaces of the bearing elements and maximizes the fatigue performance of the grout connections. Accordingly, the grout-filled half pipe bearing elements and the segmented grout-filled half pipe with pipe cap end bearing elements develop the full strength required for service and maximizes the fatigue performance of the weldments to the inner wall of the transition section and the outer wall of the monopile.

The disclosed embodiment provides a method whereby the members are joined in such a matter to allow the full forces and moments developed in the wind turbine tower assemblies during operating and extreme loading events to be transmitted to the substructure. In accordance with the disclosed embodiment the design of the grouted connection maximizes fatigue performance, stiffness and load transfer while minimizing cost and maximizing supply options.

The disclosed embodiment allows bearing elements attached to the inner wall of the transition section and the outer wall of the monopile to transfer axial forces and the overturning moments as vertical couples through the grout between bearing elements in vertical compression from the transition section to the monopile.

In accordance with the disclosed embodiment, horizontal shear forces and the overturning moments as horizontal couples are transferred through the grout between the inner wall of the monopile in horizontal compression from the transition section to the monopole.

The disclosed embodiment allows for continuous circumferential bearing elements and equally spaced circumferential segmented bearing elements of equal length. In the case of continuous circumferential bearing elements the upward couple of the overturning moment is resisted by grout between the inner wall of the transition section and outer wall of the monopile in vertical shear. Conversely, the case of segmented bearing elements resists both upward and downward couple of the overturning moment in bearing on the grout between the bearing elements.

Also, with the disclosed embodiment, the segmented bearing elements transfer torsional moments in horizontal shear through the grout between the adjacent inner wall of the transition section to the outer wall of the monopile.

The disclosed embodiment allows for half pipes filled with grout rolled to the radius of the inner wall of the transition section and welded to the inner wall of the transition section, and half pipes filled with grout rolled to the radius of the outer wall of the monopile and welded to the outer wall of the monopile to function as the bearing elements. In the ease of segmented bearing elements, half pipe caps can be welded to the ends of the half pipe segments.

With this apparatus, system and method, the case of the segmented bearing elements requires the transition section to be aligned with the monopile such that the transition section can be lowered over the monopile during installation and the segmented bearing elements on the inner wall of the transition section will pass through the gap between the segmented bearing elements on the outer wall of the monopile. The transition section is rotated to align the segmented bearing elements on the inner wall of the transition section directly above and below the segmented bearing elements of the wall of the monopile.

Similar to common practice, the cylindrical transition section and monopile with bearing elements allows the transition to be leveled by hydraulic or other means such that the tower mating flange will be in tolerance with respect to turbine tower verticality requirements. After leveling, grout can be pumped thru piping into the grout distributor at the bottom of the transition section. From the grout distributor, grout will enter through ports in the wall of the transition section into the annulus formed by the transition section inner wall and the monopile outer wall. The annulus is closed at the bottom with a flexible seal attached to the transition section below the grout distributor ports.

With the above disclosed embodiment, the following advantages are realized:

The grouted cylindrical connections utilizing bearing surfaces can develop the full strength required for service.

The grouted cylindrical connection utilizing bearing surface eliminates the requirement for conical transition sections and monopiles, thereby reducing cost an improving supply.

The vertical force due to the weight of the wind turbine tower can be transferred between the transition section and monopile by compression in the grout between the bearing elements attached to the inner wall of the transition section and outer wall of the monopile.

The overturning moment vertical couple can be transferred between the transition section and the monopile by compression in the grout between the bearing elements attached to the inner wall of the transition section and the outer wall of the monopile The horizontal forces and overturning moment horizontal couple can be transferred between the transition section and the monopile by compression in the grout between the inner wall of the transition and the outer wall of the monopile.

The torsional moment can be transferred between the transition section and the monopile by shear between the bearing elements attached to the inner wall of the transition section and the outer wall of the monopile.

The bearing elements allow the transfer of vertical forces, horizontal forces, vertical overturning moment couples and horizontal overturning moment couples through the grout between the bearing surfaces of the bearing elements and maximizes the fatigue performance of the grout connections.

The grout-filled half pipe bearing elements and the segmented grout-filled half pipe with pipe cap end bearing elements develop the full strength required for service and maximizes the fatigue performance of the weldments to the inner wall of the transition section and the outer wall of the monopile.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

What is claimed is:

1. A grouted cylindrical connection comprising a cylindrical shaped monopile;

a cylindrical shaped transition section receiving the monopile, an annulus being formed between the monopile and the transition section; and first and second bearing elements disposed in the annulus, the first bearing element being attached to the transition section and the second bearing element being attached to the monopile, wherein the annulus is filled with grout to transmit force and moment between the transition section and the monopile through grout between the first and second bearing elements, and the first bearing element is a half pipe filled with grout rolled to a radius of an inner wall of the transition section and the second bearing element is a half pipe filled with grout rolled to a radius of an outer wall of the monopile.

2. The grouted cylindrical connection according to claim 1, wherein a diameter of the transition section is larger than a diameter of the monopile.

3. The grouted cylindrical connection according to claim 1, wherein the second bearing element is attached to an outer wall of the monopile and the first bearing element is attached to an inner wall of the transition section.

4. The grouted cylindrical connection according to claim 1, wherein the first bearing element is continuously formed on a circumference of an inner wall of the transition section; and the second bearing element is continuously formed on a circumference of an outer wall of the monopile.

5. The grouted cylindrical connection according to claim 1, wherein the first bearing element includes at least one first segmented bearing element partially formed on a circumference of an inner wall of the transition section; and the second bearing element includes at least one second segmented bearing element partially formed on a circumference of an outer wall of the monopile.

6. The grouted cylindrical connection according to claim 5, further comprising caps disposed on and welded to each end of the first and second segmented bearing elements.

7. The grouted cylindrical connection according to claim 5, wherein the first segmented bearing element and the second segmented bearing element are longitudinally aligned in an axial direction of the monopile.

8. The grouted cylindrical connection according to claim 7, further comprising at least one third segmented bearing element attached to at least one of the transition section and the monopile in the annulus and aligned with the first and second segmented bearing elements in an axial direction of the monopile.

9. The grouted cylindrical connection according to claim 1, wherein the first bearing element includes a plurality of first segmented bearing elements formed on a circumference of an inner wall of the transition section; and the second bearing element includes a plurality of second segmented bearing elements formed on a circumference of an outer wall of the monopile.

10. The grouted cylindrical connection according to claim 9, wherein the plurality of first segmented bearing elements are equally spaced from adjacent first segmented bearing element; and the plurality of second segmented bearing elements are equally spaced from adjacent second segmented bearing element.

11. The grouted cylindrical connection according to claim 9, wherein a distance between adjacent second segmented bearing elements is larger than a length of the first segmented bearing elements.

12. The grouted cylindrical connection according to claim 1, wherein the first bearing element is welded to the inner wall of the transition section; and the second bearing element is welded to the outer wall of the monopile.

13. The grouted cylindrical connection according to claim 1, further comprising a flexible seal positioned between an outer wall of the monopile and an inner wall of the transition section to close the annulus.

14. A grouted cylindrical connection, comprising:

a cylindrical shaped monopile;

a cylindrical shaped transition section receiving the monopile, an annulus being formed between the monopile and the transition section;

first and second bearing elements disposed in the annulus, the first bearing element being attached to the transition section and the second bearing element being attached to the monopile; and a centralizer mounted on at least one of the first and second bearing elements, wherein the annulus is filled with grout to transmit force and moment between the transition section and the monopile through grout between the first and second bearing elements.

15. A method for forming grouted cylindrical connection, comprising the steps of:

providing a cylindrical shaped transition section to which at least one first bearing element is attached;

providing a cylindrical shaped monopile to which at least one second bearing element is attached;

lowering the transition section over the monopile along an axial direction of the monopile to form an annulus between the monopile and the transition section, the first and second bearing elements being positioned in the annulus; and filling the annulus with grout to transmit force and moment between the transition section and the monopile through grout between the first and second bearing elements, wherein the first bearing element is a half pipe filled with grout rolled to a radius of an inner wall of the transition section and the second bearing element is a half pipe filled with grout rolled to a radius of an outer wall of the monopile.

16. A method for forming grouted cylindrical connection, comprising the steps of:

providing a cylindrical shaped transition section to which first segmented bearing elements are attached;

providing a cylindrical shaped monopile to which second segmented bearing elements are attached;

lowering the transition section over the monopile such that the first segmented bearing elements passes through a gap between the second segmented bearing elements;

rotating the transition section to align the first segmented bearing elements with the second segmented bearing elements in a state where the first and second segmented bearing elements are longitudinally aligned in an axial direction of the monopile; and filling an annulus between the cylindrical shaped monopile and the cylindrical shaped transition section with grout to transmit force and moment between the transition section and the monopile through grout between the first and second bearing elements, wherein the first segmented bearing elements are half pipes filled with grout rolled to a radius of an inner wall of the transition section and the second segmented bearing elements are half pipes filled with grout rolled to a radius of an outer wall of the monopile.

* * * * *